United States Patent [19]

Wiedmer

[11] 4,355,730

[45] Oct. 26, 1982

[54] SCREW CAP WITH A GUARANTEE RING FOR INDICATING THE FIRST OPENING OF A CONTAINER

[75] Inventor: Walter Wiedmer, Näfels, Switzerland

[73] Assignee: Ernest Wiedmer, Näfels, Switzerland

[21] Appl. No.: 243,926

[22] PCT Filed: Jun. 2, 1980

[86] PCT No.: PCT/CH80/00066

§ 371 Date: Feb. 27, 1981

§ 102(e) Date: Feb. 27, 1981

[87] PCT Pub. No.: WO81/00550

PCT Pub. Date: Mar. 5, 1981

[30] Foreign Application Priority Data

Aug. 17, 1979 [CH] Switzerland ..... 7563/79

[51] Int. Cl.[3] ..... B65D 41/34

[52] U.S. Cl. ..... 215/253

[58] Field of Search ..... 215/250, 252, 253, 254, 215/256

[56] References Cited

U.S. PATENT DOCUMENTS

| | | | |
|---|---|---|---|
| 3,504,818 | 4/1970 | Crisci et al. | 215/252 |
| 3,650,428 | 3/1972 | Miller | 215/252 |
| 3,747,793 | 7/1973 | Wassilieff | 215/250 |
| 3,924,769 | 12/1975 | Fillmore | 215/253 |

*Primary Examiner*—Donald F. Norton

[57] ABSTRACT

The screw cap has a guarantee ring (3) connected to the cap (2) by means of thin flanges (4). It has its maximum thickness (d) in the vicinity of said flanges and the thickness decreases upwards. The height (h) of ring (3) is at the maximum half that of screw cap (2). Thus, the ring is strong enough not to be pressed in radially, while only requiring the absolute minimum of material necessary for its manufacture. It covers a milled surface (6) on the screw cap (2) which, after removing the same, serves for screwing down the cap. The outer surface of ring (3) and the uncovered part (**2*d*) of screw cap (2) have a smooth surface. This makes it impossible to open the cap for the illegal removal of the content of container (1) without breaking the thin flanges (4**).

3 Claims, 2 Drawing Figures

SCREW CAP WITH A GUARANTEE RING FOR INDICATING THE FIRST OPENING OF A CONTAINER

Figure 1:
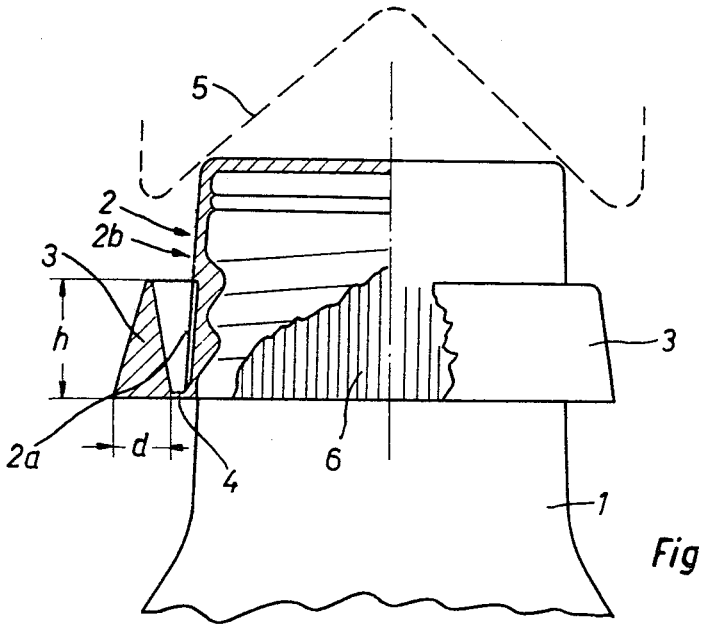

As a result of ever-increasing sales in self-service stores, it has become necessary to indicate the first opening of a container in order to show that some of the content has been removed. The problem is to prevent the unobserved checking of the content of such containers, followed by the return thereof to their original position, so that the person who finally purchases the container does not acquire it in its original full state. This problem is particularly serious with non-transparent containers. It is admittedly impossible to prevent the removal of the cap, but is must at least be made clearly visible that this has taken place. To an increasing extent, caps with a seal or guarantee strip are being increasingly used in this connection, the latter being either destroyed at the time of first opening or it becomes disconnected from the cap, so that the container in question can be withdrawn from sale.

The requirements made on such a seal can be summarized as follows.

(a) Its material expenditure and at all events its manufacturing cost must not be prohibitive.

(b) The opening of the cap must definitely lead to irreparable and clearly visible damage to the cap, the seal or the connection vbetween them.

(c) Even when taking maximum care, it must not be possible to open the cap without fulfilling feature (b).

(d) However, the seal must not be so sensitive that mere contact leads to its destruction.

(e) The cap or seal must be constructed in such a way that it does not prevent mechanical fitting by conventional filling and sealing machines and requires no additional equipment.

Numerous proposals have already been made in this field. Generally, they only fulfilled points (b) and (c), but it is important that due attention be paid to the other points, particularly the material expenditure referred to under (a). The reason for this is that in view of the vast number of caps produced even the slightest amount of excess material will lead to a vast increase in the overall manufacturing costs.

Numerous screw caps with guarantee rings for indicating the first opening of the container have been proposed. In one of these, the guarantee ring in the form of a thin strip passes round the screw cap substantially around its complete periphery and over most of its surface area. It is connected to the cap at individual points and in one constructional embodiment has a smooth surface on the inside and outside. Due to the smoothed inner surface, the ring does not adhere to the screw cap during the relative rotation of the latter. Therefore, it must be removed before the cap can be unscrewed. The visible indication of the first opening is brought about by the fact that the thin strip is creased, crumpled or even torn by the pressure of the user's fingers.

The procedure adopted by the present invention differs from this. It is in particular intended to ensure that linear contact with the cap or guarantee strip does not, as mentioned under (d) lead to damage to said strip. It is impossible to completely exclude said contact either during the packing of the containers into the boxes or receptacles used for dispatch purposes or when unpacking the containers at the point of sale. However, if the guarantee strip or its connection to the cap is damaged, then the particular container must be withdrawn from sale, even if in reality it has not been opened.

It is a further object of the invention to provide a cap in which the requirements according to point (e) (mechanical fitting) are fulfilled, i.e. without modifications to the fitting and sealing mechanism of the filling machine and without using additional devices.

The screw cap according to the present invention is characterized in that the guarantee ring has a height which at most corresponds to half the height of the screw cap and has a thickness which is greatest at the connecting points of the guarantee ring to the cap while decreasing away from the connecting points.

An embodiment is represented in the attached drawings, wherein show:

FIG. 1 a side view of the cap, partly in cross-section and partly with a broken-away guarantee ring.

Figure 2:
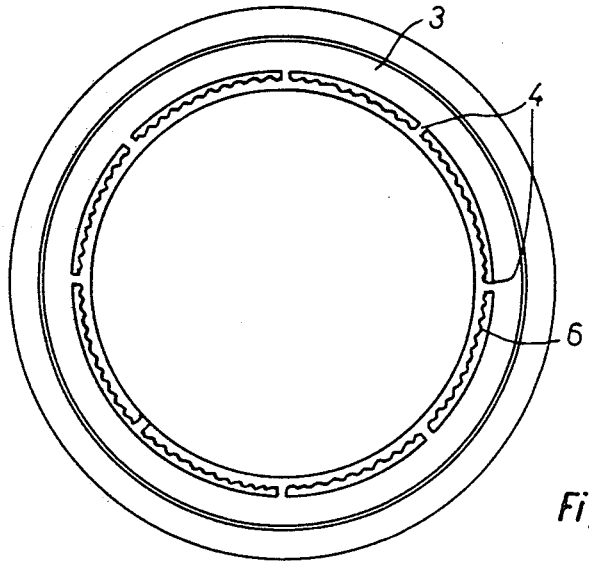

FIG. 2 a plan view of the cap.

FIG. 1 shows a container 1 with a fitted screw cap 2 surrounded by a ring 3, shown in section in the left-hand half of the drawing and partly broken away in elevation in the right-hand half. It is connected to the screw cap by means of a random number of thin or narrow bridges or flanges 4. Cap 2, ring 3 and flanges 4 are produced in one operation, normally plastic injection moulding. According to FIG. 1, the thickness of ring 3 is such that it is at a maximum in the vicinity of flanges 4 (thickness d) and decreases upwards. In this case, the cross-section is approximately triangular, but the thickness could also decrease in a non-linear manner. This general shape has been deliberately selected. At its connecting points with screw cap 2, it gives ring 3 a strength which is adequate for radially acting forces due to the pressure of the user's fingers. Thus, a deformation i.e. a pressing in of ring 3 is prevented. However, it is not necessary to provide this strength over the entire height of the ring 3, i.e. giving it a rectangular cross-section, because such a shape would need more material. It is admitted that the ring cross-section is small and an increase from the represented triangular cross-section to the mentioned rectangular cross-section would only lead to an insignificant increase in the material quantity for the individual shapes. However, as millions of such caps are produced, even such a minor increase would considerably raise the manufacuring costs.

As shown, ring 3 has a height h which, at the maximum, corresponds to approximately half the height of the screw cap 2. This height h is completely adequate and as a result the material expenditure is limited to what is absolutely necessary.

Another reason why the ring coannot be made higher is the construction of the container filling machines, particularly when used in the beverages industry. In such machines, the cap is grasped by a so-called bell 5, whose contours are shown in dotted line form in FIG. 1, pressed onto the container 1 and screwed onto the same by rotating bell 5, accompanied by a simultaneous advance. As is readily apparent, the bell only comes into contact with the rounded upper edge of the cap and as the caps have a standardized diameter, the same applies to the bells. It is clear that the diameter must not be changed. Thus, a guarantee ring must terminate well below this edge area, so that it is not picked up by the bell. This would lead to an immediate breaking of the thin flanges 4 and consequently to an inadequate fitting of the complete cap, quite apart from the fact that the guarantee ring would not then be connected to the screw cap 2.

The lower half 2*a* of the surface of cap 2 is roughened. This roughness is preferably in the form of a milled surface 6, but consideration can also be given to other surface forms. In the case of intact connections to ring 3, said half 2*a* is completely covered by ring 3. The upper half 2*b* of the surface is completely smooth, in the same way as ring 3.

Testing of the cap has shown that it is impossible to detach the mechanically screwed-down cap without tools in such a way that the guarantee ring remains connected in intact manner with the screw cap. For the fingers, the upper half 2*b* has a too limited height and a too smooth surface to act as the sole action surface. It is therefore necessary to grip the ring, leading to the immediate breaking of flanges 4, so that ring 3 hangs loosely downwards. The cap cannot be removed without damage, even when using tools, such as e.g. flat pliers or tin openers. The reasons are that upper half 2*b* is too high and in particular too smooth for such tools.

I claim:

1. In combination: a screw cap for a container, and a guarantee ring for indicating the first removal of the screw cap from the container, said guarantee ring surrounding said screw cap over the circumference thereof and over part of the surface area thereof, said guarantee ring being connected at a plurality of individual points to said cap, both the inside and outside of said ring being smooth, said guarantee ring having a height which at most corresponds to half the height of said screw cap and having a thickness which is greatest at the connecting points to said cap and which decreases away from said connecting points over the height of the screw cap.

2. The combination according to claim 1, wherein the thickness of said screw cap decreases linearly away from said connecting points.

3. The combination according to claim 1 or 2, wherein the screw cap is smooth over part of its surface area and is rough over the remainder of said surface area, and wherein said guarantee ring surrounds said rough part of said surface area.

* * * * *